US010422333B2

(12) United States Patent
Reukers

(10) Patent No.: US 10,422,333 B2
(45) Date of Patent: Sep. 24, 2019

(54) ULTRA HIGH PRESSURE PUMP

(75) Inventor: Darren Reukers, Campbellfield (AU)

(73) Assignee: QUANTUM SERVO PUMPING TECHNOLOGIES PTY LTD, Campbellfie LD, VIC (AU)

( * ) Notice: Subject to any disclaimer, the term of this patent is extended or adjusted under 35 U.S.C. 154(b) by 0 days.

(21) Appl. No.: 13/822,409

(22) PCT Filed: Sep. 12, 2011

(86) PCT No.: PCT/AU2011/001171

§ 371 (c)(1),
(2), (4) Date: Mar. 12, 2013

(87) PCT Pub. No.: WO2012/034165

PCT Pub. Date: Mar. 22, 2012

(65) Prior Publication Data

US 2013/0167697 A1 Jul. 4, 2013

(30) Foreign Application Priority Data

Sep. 13, 2010 (AU) ..... 2010904106

(51) Int. Cl.
*F04B 49/06* (2006.01)
*B26F 3/00* (2006.01)
*F04B 9/113* (2006.01)

(52) U.S. Cl.
CPC ..... *F04B 49/065* (2013.01); *B26F 3/004* (2013.01); *F04B 9/113* (2013.01);
(Continued)

(58) Field of Classification Search
CPC .. B26F 3/004; B26F 1/26; B26F 3/008; B26F 2003/006; B24C 5/02; B24C 1/045;
(Continued)

(56) References Cited

U.S. PATENT DOCUMENTS 2,245,457 A 6/1941 Brassell
2,913,988 A 11/1959 Howard
(Continued)

FOREIGN PATENT DOCUMENTS

AU 2009227976 A1 10/2009
CN 101970875 A 2/2011
(Continued)

OTHER PUBLICATIONS

Written Opinion dated Jul. 6, 2009 by the International Searching Authority for Application PCT/AU2009/000334, filed on Mar. 24, 2009 (Applicant—Techni Waterjet Pty, Ltd // Inventor—Reukers) (9 pages).

(Continued)

*Primary Examiner* — Evan H MacFarlane
(74) *Attorney, Agent, or Firm* — Potomac Law Group, PLLC; Kenneth Fagin

(57) ABSTRACT

An ultra high pressure pump having a servo motor coupled to a piston having a head arranged within a cylinder to define a pumping chamber, whereby the servo motor rotation causes reciprocal displacement of the piston to pressurize fluid in the pumping chamber to pressures greater than 50,000 psi, the servo motor having a feedback loop coupled to a computer, the feedback loop including a pressure feedback signal to control the pump pressure in real time.

20 Claims, 6 Drawing Sheets

(52) U.S. Cl.
CPC ..... *F04B 2203/0903* (2013.01); *F04B 2203/1201* (2013.01); *F04B 2205/03* (2013.01); *Y10T 83/0591* (2015.04); *Y10T 83/148* (2015.04)

(58) Field of Classification Search
CPC ..... F04B 49/065; F04B 2203/09; F04B 2203/0902; F04B 2203/0903; F04B 2203/1201; F04B 2205/03; F04B 2205/04; F04B 2205/05; F04B 2205/06; F04B 2205/063; Y10T 83/0591; Y10T 83/148; Y10T 83/364
USPC ..... 83/53, 177; 417/44.11, 44.2, 412–414; 451/36–38
See application file for complete search history.

(56) References Cited

U.S. PATENT DOCUMENTS

| | | | | |
|---|---|---|---|---|
| 2,983,553 | A | 5/1961 | Dexter | |
| 3,157,058 | A | 11/1964 | Haller | |
| 3,415,419 | A | 12/1968 | Jewett | |
| 3,847,507 | A | 11/1974 | Sakiyama et al. | |
| 3,997,111 | A | 12/1976 | Thomas et al. | |
| 4,089,624 | A | 5/1978 | Nichols et al. | |
| 4,145,165 | A * | 3/1979 | Perkins | E21B 21/01 310/80 |
| 4,150,925 | A | 4/1979 | Perkins | |
| 4,232,562 | A | 11/1980 | Perkins | |
| 4,276,003 | A | 6/1981 | Perkins et al. | |
| 4,380,138 | A | 4/1983 | Hofer | |
| 4,381,747 | A | 5/1983 | Kobayashi et al. | |
| 4,729,717 | A | 3/1988 | Gupta | |
| 5,130,585 | A | 7/1992 | Iwamatsu et al. | |
| 5,511,439 | A | 4/1996 | Las Navas Garcia | |
| 5,513,956 | A | 5/1996 | Lewis et al. | |
| 5,523,640 | A | 6/1996 | Sparer et al. | |
| 5,554,899 | A | 9/1996 | Teramachi | |
| 5,557,154 | A | 9/1996 | Erhart | |
| 5,704,250 | A | 1/1998 | Black | |
| 5,772,403 | A | 6/1998 | Allison et al. | |
| 5,787,998 | A | 8/1998 | O'Hanlon et al. | |
| 5,844,335 | A | 12/1998 | Sekiguchi | |
| 5,992,222 | A | 11/1999 | Belonenko et al. | |
| 5,993,181 | A | 11/1999 | Hudelmaier | |
| 6,066,446 | A | 5/2000 | Muratsubaki et al. | |
| 6,068,448 | A * | 5/2000 | Muratsubaki | F04B 3/00 417/212 |
| 6,086,339 | A | 7/2000 | Jeffrey | |
| 6,126,524 | A * | 10/2000 | Shepherd | B24C 1/00 134/172 |
| 6,139,288 | A | 10/2000 | Karasawa | |
| 6,220,529 | B1 | 4/2001 | Xu | |
| 6,230,492 | B1 | 5/2001 | Kingston et al. | |
| 6,398,514 | B1 | 6/2002 | Smith et al. | |
| 6,749,408 | B1 | 6/2004 | Eilertsen | |
| 7,080,792 | B2 * | 7/2006 | Muratsubaki | F04B 49/065 239/373 |
| 8,167,591 | B1 | 5/2012 | Sorensen | |
| 9,212,657 | B2 | 12/2015 | Reukers | |
| 2002/0066345 | A1 * | 6/2002 | Shepherd | B24C 1/045 83/53 |
| 2007/0006699 | A1 * | 1/2007 | Kumar | B26D 7/08 83/53 |
| 2007/0057579 | A1 | 3/2007 | Miyamoto | |
| 2008/0063535 | A1 * | 3/2008 | Koehl | F04D 15/0088 417/18 |
| 2010/0047083 | A1 | 2/2010 | Johnston | |
| 2010/0111721 | A1 | 5/2010 | Servin et al. | |
| 2011/0176940 | A1 | 7/2011 | Ellis et al. | |
| 2011/0177905 | A1 | 7/2011 | Choi | |
| 2013/0167697 | A1 | 7/2013 | Reukers | |
| 2013/0272873 | A1 | 10/2013 | Collins | |
| 2016/0076526 | A1 | 3/2016 | Reukers | |

FOREIGN PATENT DOCUMENTS

| | | | |
|---|---|---|---|
| CN | 20216005 | U | 3/2012 |
| CN | 202160055 | U | 3/2012 |
| CN | 103154532 | A | 6/2013 |
| DE | 4300512 | A1 | 7/1994 |
| EP | 2268922 | A1 | 1/2011 |
| EP | 2616690 | A1 | 7/2013 |
| FR | 2493419 | A1 | 5/1982 |
| FR | 2493419 | A1 | 5/1982 |
| GB | 2385104 | A | 8/2003 |
| GB | 2385104 | A | 8/2003 |
| JP | 2011-501061 | A | 1/2011 |
| WO | WO-1990/012962 | A1 | 11/1990 |
| WO | WO-2009/117765 | A1 | 10/2009 |
| WO | WO 2012/034165 | | 3/2012 |
| WO | 2015076725 | A1 | 5/2015 |
| WO | WO-2015/076725 | A1 | 5/2015 |

OTHER PUBLICATIONS

International Search Report dated Jul. 6, 2009 by the International Searching Authority for Application PCT/AU2009/000334, filed on Mar. 24, 2009 (Applicant—Techni Waterjet Pty, Ltd // Inventor—Reukers) (5 pages).
International Search Report dated Mar. 22, 2012 by the International Searching Authority for Application PCT/AU2011/001171, filed on Sep. 12, 2011 (Applicant—Techni Waterjet Pty, Ltd // Inventor—Reukers) (3 pages).
Non-Final Office Action dated Feb. 28, 2013 for U.S. Appl. No. 12/934,547, filed Oct. 7, 2010 and published as US-2011-0020155-A1 on Jan. 27, 2011 (Applicant—Techni Waterjet Pty, Ltd // Inventor—Reukers) (14 pages).
Response to Non-Final Office Action filed on Apr. 8, 2013 for U.S. Appl. No. 12/934,547, filed Oct. 7, 2010 and published as US-2011-0020155-A1 on Jan. 27, 2011 (Applicant—Techni Waterjet Pty, Ltd // Inventor—Reukers) (14 pages).
Final Office Action dated Aug. 29, 2013 for U.S. Appl. No. 12/934,547, filed Oct. 7, 2010 and published as US-2011-0020155-A1 on Jan. 27, 2011 (Applicant—Techni Waterjet Pty, Ltd // Inventor—Reukers) (14 pages).
Response to Final Office Action filed on Oct. 8, 2013 for U.S. Appl. No. 12/934,547, filed Oct. 7, 2010 and published as US-2011-0020155-A1 on Jan. 27, 2011 (Applicant—Techni Waterjet Pty, Ltd // Inventor—Reukers) (7 pages).
Advisory Action dated Oct. 24, 2013 for U.S. Appl. No. 12/934,547, filed Oct. 7, 2010 and published as US-2011-0020155-A1 on Jan. 27, 2011 (Applicant—Techni Waterjet Pty, Ltd // Inventor—Reukers) (7 pages).
Amendment Response to Final Office Action filed on Nov. 4, 2013 for U.S. Appl. No. 12/934,547, filed Oct. 7, 2010 and published as US-2011-0020155-A1 on Jan. 27, 2011 (Applicant—Techni Waterjet Pty, Ltd // Inventor—Reukers) (8 pages).
Non-Final Office Action dated May 6, 2014 for U.S. Appl. No. 12/934,547, filed Oct. 7, 2010 and published as US-2011-0020155-A1 on Jan. 27, 2011 (Applicant—Techni Waterjet Pty, Ltd // Inventor—Reukers) (24 pages).
Response to Non-Final Office Action filed on Aug. 6, 2014 for U.S. Appl. No. 12/934,547, filed Oct. 7, 2010 and published as US-2011-0020155-A1 on Jan. 27, 2011 (Applicant—Techni Waterjet Pty, Ltd // Inventor—Reukers) (11 pages).
Response to Final Office Action filed on Apr. 6, 2015 for U.S. Appl. No. 12/934,547, filed Oct. 7, 2010 and published as US-2011-0020155-A1 on Jan. 27, 2011 (Applicant—Techni Waterjet Pty, Ltd // Inventor—Reukers) (14 pages).
Amendment and Response to Final Office Action filed on Aug. 3, 2015 for U.S. Appl. No. 12/934,547, filed Oct. 7, 2010 and published as US-2011-0020155-A1 on Jan. 27, 2011 (Applicant—Techni Waterjet Pty, Ltd // Inventor—Reukers) (15 pages).
Notice of Allowance and Fees Due dated Sep. 29, 2014 for U.S. Appl. No. 12/934,547, filed Oct. 7, 2010 and published as US-2011-0020155-A1 on Jan. 27, 2011 (Applicant—Techni Waterjet Pty, Ltd // Inventor—Reukers) (15 pages).

(56) References Cited

OTHER PUBLICATIONS

Parker, D., Positive Displacement Pumps—Performance and Application. 11th International Pump Users Symposium. (1994) (1-5 pages).
Tackett, H. et al., Positive Displacement Reciprocating Pump Fundamentals—Power and Direct Acting Types. 24th International Pump Users Symposium (2008) (1-14 pages).
Final Office Action dated Feb. 5, 2015 for U.S. Appl. No. 12/934,547, filed Oct. 7, 2010 and published as US-2011-0020155-A1 on Jan. 27, 2011 (Applicant—Techni Waterjet Pty, Ltd // Inventor—Reukers) (23 pages).
Issue Notification dated Nov. 24, 2015 by the U.S. Patent and Trademark Office for U.S. Appl. No. 12/934,547, filed Mar. 24, 2009 and granted as now U.S. Pat. No. 9,212,657 on Dec. 15, 2015 (Inventor—Darren Reukers) (1 page).
Preliminary Amendment filed on Nov. 30, 2015 to the U.S. Patent and Trademark Office for U.S. Appl. No. 14/954,110, filed Nov. 30, 2015 and published as US-2016-0076526-A1 on Mar. 17, 2016 (Inventor—Darren Reukers) (5 pages).
Non Final Rejection dated Sep. 6, 2016 by the U.S. Patent and Trademark Office for U.S. Appl. No. 14/954,110, filed Nov. 30, 2015 and published as US-2016-0076526-A1 on Mar. 17, 2016 (Inventor—Darren Reukers) (26 pages).
International Preliminary Report on Patentability dated Jun. 25, 2010 by the International Searching Authority for application PCT/AU2009/000334, filed on Mar. 24, 2009 (Applicant—Techni Waterjet Pty, Ltd // Inventor—Reukers) (10 pages).
Written Opinion dated Dec. 12, 2011 by the International Searching Authority for Application PCT/AU2011/001171, filed on Sep. 12, 2011 (Applicant—Techni Waterjet Pty, Ltd // Inventor—Reukers) (4 pages).
International Preliminary Report on Patentability dated Mar. 19, 2013 by the International Searching Authority for Application PCT/AU2011/001171, filed on Sep. 12, 2011 (Applicant—Techni Waterjet Pty, Ltd // Inventor—Reukers) (5 pages).
First Office Action dated Dec. 31, 2011, by the SIPO for application CN 200980109183, filed on Mar. 24, 2009, and published as CN 101970875 on Feb. 9, 2011 (Applicant—Techni Waterjet Pty Ltd.) (Original—11 pages // Translation—5 pages).
Second Office Action dated Sep. 25, 2012, by the SIPO for application CN 200980109183, filed on Mar. 24, 2009, and published as CN 101970875 on Feb. 9, 2011 (Applicant—Techni Waterjet Pty Ltd.) (Original—3 pages // Translation—4 pages).
Third Office Action dated Mar. 5, 2013, by the SIPO for application CN 200980109183, filed on Mar. 24, 2009, and published as CN 101970875 on Feb. 9, 2011 (Applicant—Techni Waterjet Pty Ltd.) (Original—4 pages // Translation—6 pages).
Fourth Office Action dated Aug. 13, 2013, by the SIPO for application CN 200980109183, filed on Mar. 24, 2009, and published as CN 101970875 on Feb. 9, 2011 (Applicant—Techni Waterjet Pty Ltd.) (Original—3 pages // Translation—4 pages).
Fifth Office Action dated Nov. 28, 2013, by the SIPO for application CN 200980109183, filed on Mar. 24, 2009, and published as CN 101970875 on Feb. 9, 2011 (Applicant—Techni Waterjet Pty Ltd.) (Original—5 pages // Translation—7 pages).
Notice of Allowance dated May 14, 2014, by the SIPO for application CN 200980109183, filed on Mar. 24, 2009, and published as CN 101970875 on Feb. 9, 2011 (Applicant—Techni Waterjet Pty Ltd.) (Original—1 pages // Translation—2 pages).
Patent Examination Report No. 1 dated Apr. 30, 2013, by the Australian Patent Office for application AU 2009227976, filed Aug. 31, 2010 (Applicant—Techni Waterjet Pty Ltd.) (4 pages).
Patent Examination Report No. 2 dated Jan. 9, 2015, by the Australian Patent Office for application AU 2009227976, filed Aug. 31, 2010 (Applicant—Techni Waterjet Pty Ltd.) (4 pages).
First Office Action dated Aug. 19, 2014, by the SIPO for application CN 201180043372, filed on Sep. 12, 2011, and published as CN 103154532 on Jun. 12, 2013 (Applicant—Techni Waterjet Pty Ltd.) (Original—5 pages // Translation—8 pages).
Second Office Action dated Jun. 2, 2015, by the SIPO for application CN 201180043372, filed on Sep. 12, 2011, and published as CN 103154532 on Jun. 12, 2013 (Applicant—Techni Waterjet Pty Ltd.) (Original—6 pages // Translation—9 pages).
Notice of Allowance dated Dec. 9, 2015, by the SIPO for application CN 201180043372, filed on Sep. 12, 2011, and published as CN 103154532 on Jun. 12, 2013 (Applicant—Techni Waterjet Pty Ltd.) (Original—1 pages // Translation—2 pages).
Claims Amendment dated Sep. 14, 2010 to the European Patent Office for EP Application No. 09726155.6 filed Mar. 24, 2009 and published as EP 2268922 on Jan. 5, 2011 (Inventor—Darren Reukers; Applicant—Techni Waterjet Pty Ltd.) (3 pages).
Extended European Search Report dated Mar. 10, 2017 by the European Patent Office for Patent Application No. 09726155.6, which was filed on Apr. 24, 2009 and published as EP 2268922 on Jan. 5, 2011 (Inventor—Darren Reukers et al.; Applicant—Techni Waterjet Pty Ltd.) (10 pages).
Notice of Allowance dated Sep. 29, 2015 by the U.S. Patent and Trademark Office for U.S. Appl. No. 12/934,547, filed Mar. 24, 2009 and granted as now U.S. Pat. No. 9,212,657 on Dec. 15, 2015 (Inventor—Darren Reukers) (14 pages).
Response to Non-Final Office Action filed on Feb. 23, 2017 with the U.S. Patent and Trademark Office for U.S. Appl. No. 14/954,110, filed Nov. 30, 2015 and published as US 2016/0076526 on Mar. 17, 2016 (Inventor—Darren Reukers; Applicant—Techni Waterjet Pty Ltd.) (10 pages).
Terminal Disclaimer filed on Mar. 31, 2017 with the U.S. Patent and Trademark Office for U.S. Appl. No. 14/954,110, filed Nov. 30, 2015 and published as US 2016/0076526 on Mar. 17, 2016 (Inventor—Darren Reukers; Applicant—Techni Waterjet Pty Ltd.) (2 pages).
Terminal Disclaimer Approval issued on Mar. 31, 2017 by the U.S. Patent and Trademark Office for U.S. Appl. No. 14/954,110, filed Nov. 30, 2015 and published as US 2016/0076526 on Mar. 17, 2016 (Inventor—Darren Reukers; Applicant—Techni Waterjet Pty Ltd.) (1 page).
Notice of Allowance dated Apr. 12, 2017 by the U.S. Patent and Trademark Office for U.S. Appl. No. 14/954,110, filed Nov. 30, 2015 and published as US 2016/0076526 on Mar. 17, 2016 (Inventor—Darren Reukers; Applicant—Techni Waterjet Pty Ltd.) (10 pages).
Notice of Abandonment dated Aug. 2, 2017 by the U.S. Patent and Trademark Office for U.S. Appl. No. 14/954,110, filed Nov. 30, 2015 and published as US 2016/0076526 on Mar. 17, 2016 (Inventor—Darren Reukers; Applicant—Techni Waterjet Pty Ltd.) (1 page).
Preliminary Amendment filed on Jul. 11, 2017 with the U.S. Patent and Trademark Office for U.S. Appl. No. 15/646,765, filed Jul. 11, 2017 (Inventor—Darren Reukers; Applicant—Techni Waterjet Pty Ltd.) (7 pages).
Supplementary European Search Report dated Dec. 15, 2017 by the European Patent Office for Patent Application No. 11824344.3, which was filed on Sep. 12, 2011 and published as EP 2616690 on Jul. 24, 2013 (Inventor—Darren Reukers; Applicant—Techni Waterjet Pty Ltd.) (7 pages).
Preliminary Amendment filed Oct. 26, 2017 with the U.S. Patent & Trademark Office for U.S. Appl. No. 15/646,765, filed Jul. 11, 2017 and published as U.S. 2017-0306938 (Inventor—Darren Reukers; Applicant—Techni Waterjet Pty Ltd.) (6 pages).

* cited by examiner

B-B

ULTRA HIGH PRESSURE PUMP

CROSS REFERENCE TO RELATED APPLICATIONS

The present application is a National Phase Application of International Application No. PCT/AU2011/001171, filed Sep. 12, 2011, which claims priority to Australian Patent Applications No. 2010904106, Sep. 13, 2010, which applications are incorporated herein fully by this reference.

This invention relates to an ultra high pressure pump particularly for use in waterjet cutting apparatus.

BACKGROUND OF THE INVENTION

Waterjet cutting apparatus has been used for some years to cut a variety of materials such as steel, aluminium, glass, marble, plastics, rubber, cork and wood. The work piece is placed over a shallow tank of water and a cutting head expelling a cutting jet is accurately displaced across the work piece to complete the desired cut. The cutting action is carried out by the combination of a very high pressure jet (up to 90,000 psi) of water entrained with fine particles of abrasive material, usually sand, that causes the cutting action. The water and sand that exit the cutting head are collected beneath the work piece in the tank.

It is in the industry associated with waterjet cutting that the expression "ultra high pressure" (UHP) waterjets are used to define a process where water is pressurised above 50,000 psi and then used as a cutting tool. The high pressure water is forced through a very small hole which is typically between 0.1 mm and 0.5 mm in diameter in a jewel which is often ruby, sapphire or diamond.

Although pressures greater than 50,000 psi are defined as ultra high pressure it is envisaged that these pressures could be as great as 100,000 psi.

In our co-pending patent application WO 2009/117765 we disclose an ultra high pressure pump that has been specifically designed for use with a particular type of waterjet cutting apparatus. The issues of compactness and efficiency are critical to pumps of this nature and there is a need for pump to operate reliably at ultra high pressures. There is also a need for the pumps to be designed in a manner that they can be readily fitted to many types of existing waterjet cutting machines. There is also a need for the pumps to regulate the pressure accurately with minimal pressure variation.

It is these issues that have brought about the present invention.

SUMMARY OF THE INVENTION

According to a first aspect of the present invention there is provided an ultra high pressure pump comprising a servo motor coupled to a piston having a head arranged within a cylinder to define a pumping chamber, whereby the servo motor rotation causes reciprocal displacement of the piston to pressurise fluid in the pumping chamber to pressures greater than 50,000 psi, the servo motor having a feedback loop coupled to a computer, the feedback loop including a pressure feedback signal to control the pump pressure in real time.

According to a further aspect of the present invention there is provided an ultra high pressure pump comprising a servo motor adapted to axially rotate a hollow rotor shaft in alternating directions, the servo motor having a stator positioned co-axially around the hollow rotor shaft with the interior of the rotor shaft being co-axially coupled to drive means to convert axial rotation into reciprocal displacement, the drive means having opposed ends, each end coupled to a piston having a head arranged within a cylinder to define a pumping chamber between the head of the piston and the cylinder, whereby alternating rotation of the rotor shaft causes reciprocal linear displacement of the pistons to pressurise fluid in the pumping chambers to pressures greater than 50,000 psi, the servo motor including an encoder to monitor position or velocity of the drive means, means to monitor the current flowing through the stator and a pressure sensor coupled to the output of the pumping chambers, whereby signals from the encoder, pressure sensor and stator are fed back to a computerised control unit to ensure that the pump operates at a selected pressure.

Preferably the output of the pumping chambers is coupled to a pressure transducer.

DESCRIPTION OF THE DRAWINGS

An embodiment of the present invention will now be described by way of example only with reference to the accompanying drawings in which.

DESCRIPTION OF THE PREFERRED EMBODIMENT

Figure 1:
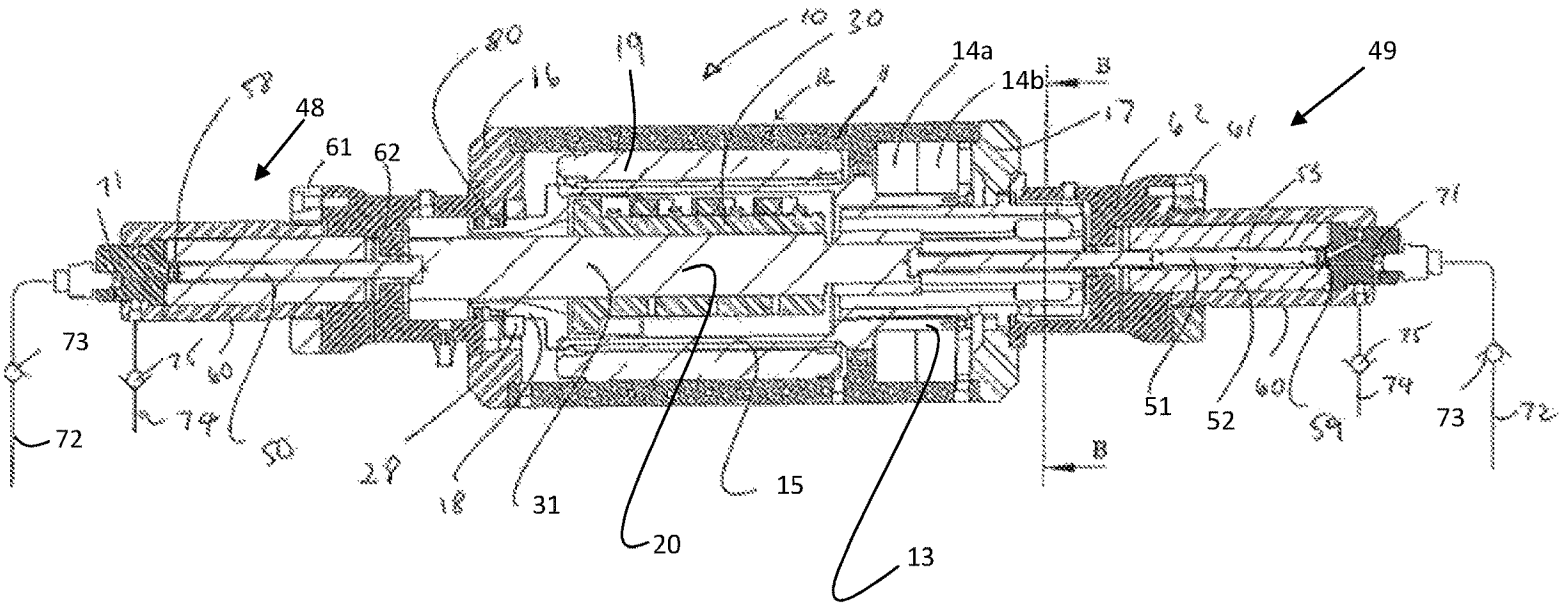
FIG. 1 is a cross-sectional view of an ultra high pressure pump in accordance with an embodiment of the invention.
Figure 2:
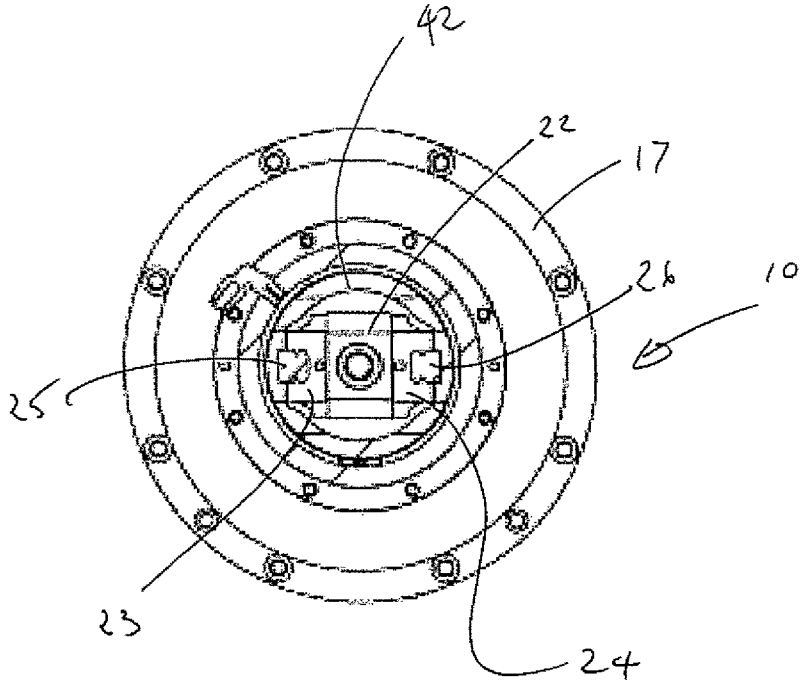
FIG. 2 is a cross-sectional view taken along the lines B-B of FIG. 1.

As shown in FIG. 1, an ultra high pressure pump 10 comprises a cylindrical housing 11 that has embedded therein water cooling jacket 12. The housing 11 has end caps 16, 17 that support a hollow rotor shaft 15 about windings of a servo motor. indicated as stator 19. One end 13 of the rotor shaft 15 is supported by annular bearings 14A, 14B located between the housing 11 and the rotor shaft 15. The other end 18 of the rotor shaft 15 is supported with the end cap 16 by a bearing 28, The end 18 also supports an encoder 80 housed by the end cap 16. The encoder 80 monitors position or velocity of the rotor shaft 15.

Figure 3:
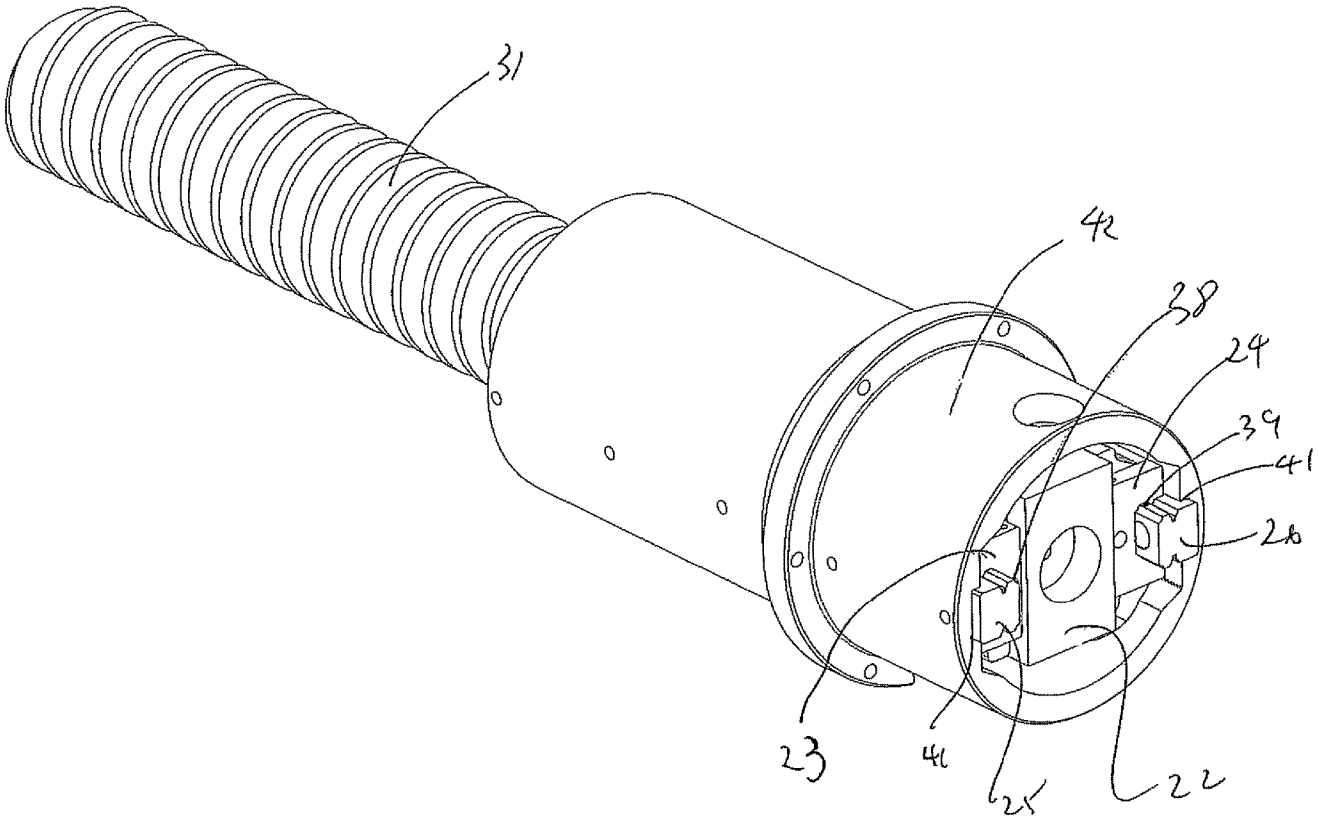
FIG. 3 is a perspective view of a ball screw supported by rails and linear bearings.

The rotor shaft 15 houses a ball screw nut 30 which is in turn threadedly engaged onto an elongated ball screw 31. The ball screw nut 30 is in direct engagement with the interior of the rotor shaft 15 and is constrained against linear movement to rotate with the rotor shaft 15. The screw 31 has a threaded exterior 20 with one end 22 machined square. The squared end 22 fits between opposed linear bearings 23, 24 which run on elongate opposed rails 25, 26 (FIG. 3). The rails 25, 26 extend past the end cap 17 of the housing 11.

Figure 4:
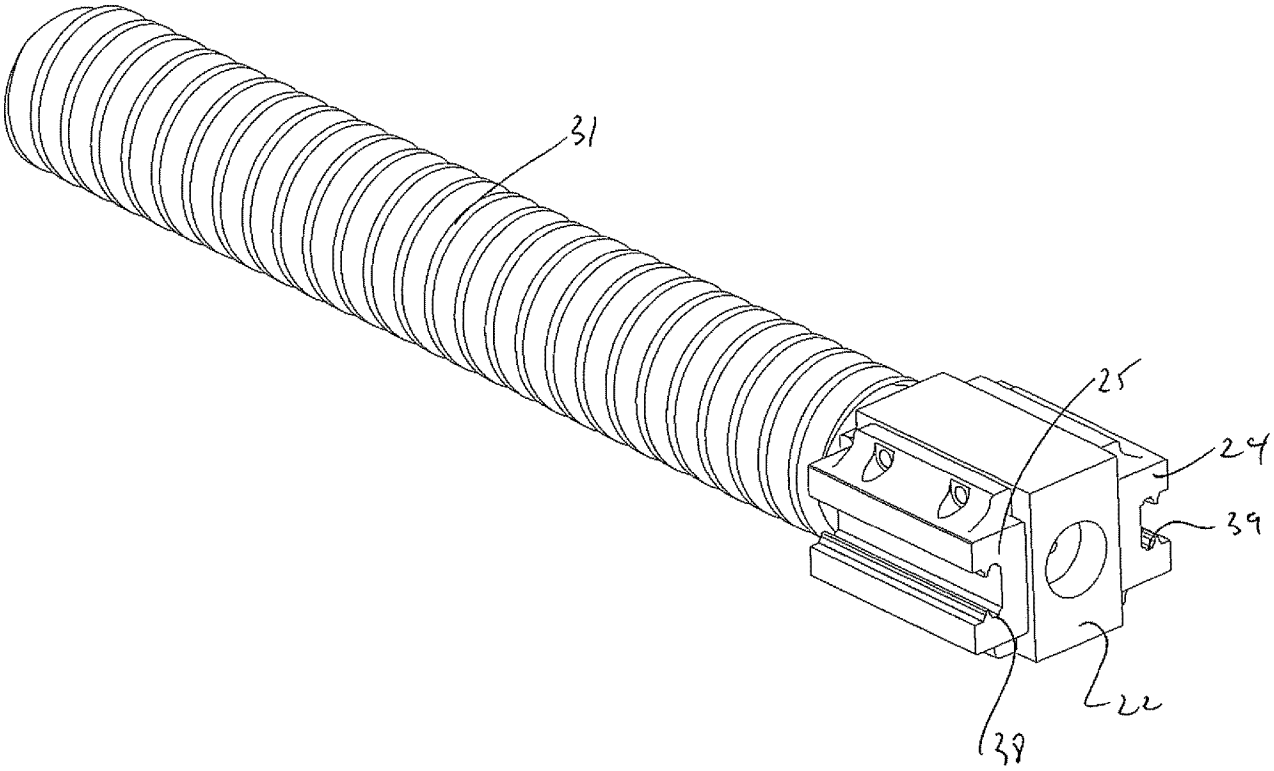
FIG. 4 is a perspective view of the ball screw.
Figure 5:
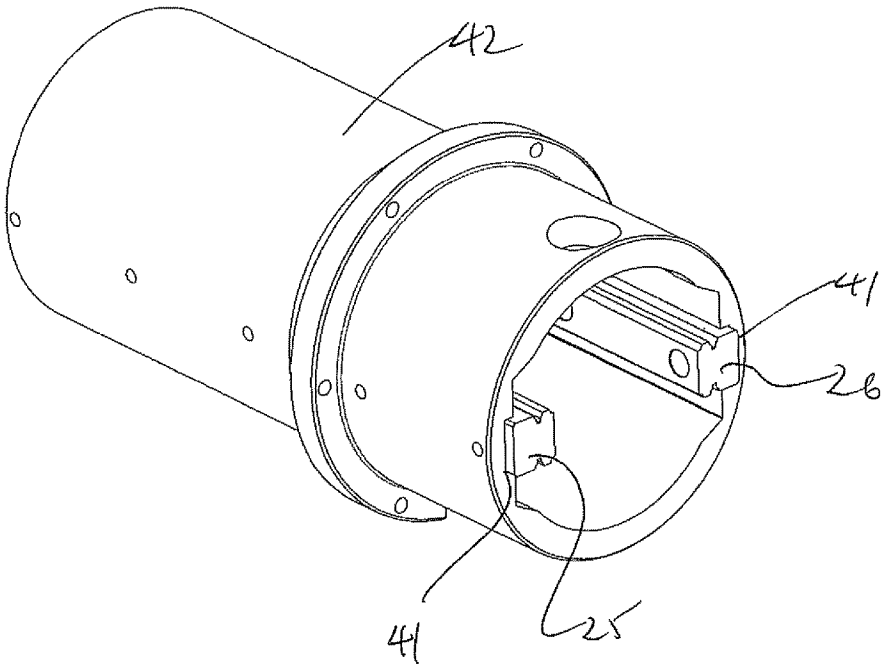
FIG. 5 is a perspective view of a support for the ball screw.

As shown in FIGS. 3 to 5 the squared end 22 of the ball screw 31 is supported by linear bearings 23, 24 that engage opposed surfaces. Each linear bearing 23, 24 has an outer surface that is grooved 38, 39 to accommodate an elongate rail 25, 26 which is in turn secured within a groove 41 in a cylindrical rail support 42 located within the rotor shaft 15. Suitable oil ways (not shown) are provided to provide passage of oil to the linear bearings 23, 24 and rails 25, 26 and the arrangement is such that the linear bearings 23, 24 by engaging the squared end 22 of the ball screw 31 prevent rotation of the ball screw 31 yet facilitate longitudinal displacement of the ball screw. The linear rails 25, 26 are fixed to the interior of the rail support 42 and the dovetailed cross section of each rail 25 or 26 provides a smooth running but highly toleranced fit between the bearing 23 or 24 and the rail 25 or 26.

As shown in FIG. 1 opposite ends of the ball screw are coupled to piston/cylinder pumping assemblies 48, 49. Each assembly 48, 49 comprises a cylinder body 52 with a narrow internal bore 53 in which a piston 50, 51 that is coupled to the end of the ball screw is arranged to reciprocate. The piston 50, 51 terminates in a head that would carry appropriate sealing rings (not shown) to define with the cylinder a pressure chamber 58, 59. Each cylinder 52 is in turn supported by a retaining sleeve 60 that is held onto the end of the pump via a flange 61 that is bolted to an adaptor 62 that is in turn bolted to the end cap 16 or 17 of the housing. The end of each cylinder retaining sleeve 60 supports a valve assembly that incorporates an end block 71 into which a water inlet 74 flows via an internal low pressure check valve 75 to an outlet pipe 72 of narrow diameter that is in turn controlled by high pressure check valve 73.

The servo motor causes the rotor shaft 15 to rotate which in turn rotates the roller nut 30 which is constrained from axial movement thus meaning that the ball screw 31 moves linearly within the roller nut 30. By reversing the direction of rotation of the rotor shaft 15, the screw 31 can thus be caused to reciprocate back and forth to give reciprocating motion to the pistons 50, 51 to in turn pressurise the water that is introduced into the compression chambers 58, 59 via the water inlets 74 to effect high pressure delivery of water from the outlets 72 at pressures greater than 50,000 psi and up to 100,000 psi.

Each valve assembly has the low pressure water inlet 74 controlled by the check valve 75 communicating with the compression chambers 58, 59 at a 45.degree. angle to axis of the cylinder. The high pressure outlet 72 is positioned co-axial to the end of the cylinder having an internal high pressure check valve 73 and transfers the water at high pressure to an attenuator (not shown).

High pressure seals are positioned between the inner ends of the cylinders 52 and the pistons 50, 51 to prevent back pressure.

The servo motor which is used in the preferred embodiment is a brushless DC motor operating on a DC voltage of about 600 volts. This is a motor which is commonly used in machine tools and has traditionally been very controllable to provide the precision which is required in such machine tool applications. The pistons have a stroke of between 100 and 200 mm (preferably 168 mm) and reciprocate at approximately 60 to 120 strokes per minute. The movement of a piston in one direction lasts about 0.8 seconds. The pump is designed to operate in the most efficient mode with the delivery of water of between 2 L per minute and 8 L per minute.

Figure 6:
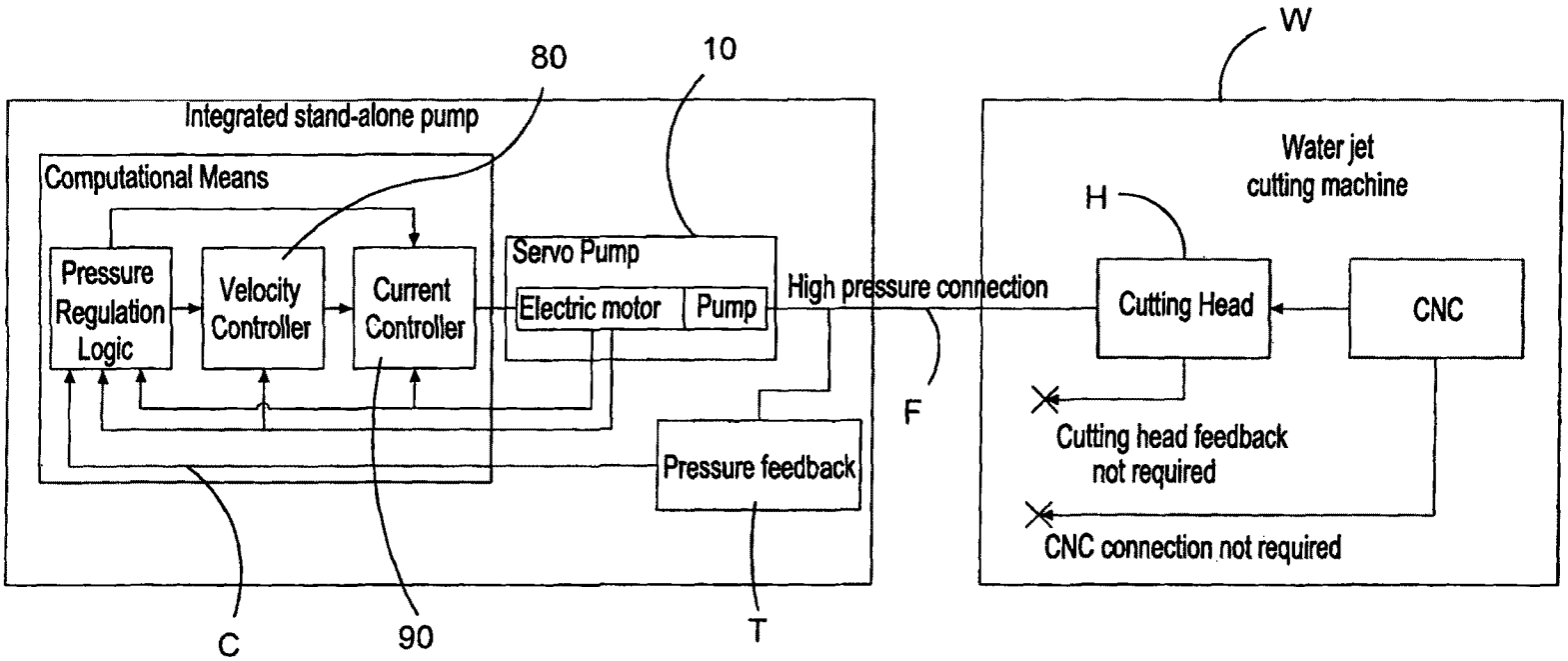
FIG. 6 is a flow chart showing the pump coupled to a waterjet cutting machine and illustrating the operational control.

FIG. 6 is a flow chart showing the pump 10 coupled to a high pressure water cutting machine W that has a cutting head H and is controlled by a CNC controller. The CNC controller only controls the operation of the cutting machine W and not the high pressure pump 10.

As shown in FIGS. 1 and 6 the ultra high pressure pump 10 is coupled at either end to a source of water at the inlets 74. The high pressure water outlets 72 are coupled via an attenuator (not shown) to a high pressure water feed (F) which is coupled to the cutting heard H of the waterjet cutting machine W. A pressure transducer T provides a signal proportional to the outlet pressure which is fed back to a computer C associated with the pump 10. The pump 10 also includes feedback signals from the position or velocity encoder 80 and a stator current monitor 90. The computer C allows an operator to select a pressure usually between 50,000 psi and 100,000 psi with the pump then operating in real time to maintain that pressure.

As shown in FIG. 6 the pressure transducer T is positioned into the high pressure waterline between the high pressure check valves 73 and the cutting head H. This information is then fed directly into the computer C of the drive to enable accurate control of the pressure, in real time, without the need to know when and how much water is being dispersed from the cutting head.

Known systems require the feedback of the position, velocity, and current to be fed into the CNC controller where pressure adjustments are made by modifying the velocity to suit the given pressure and flow. This form of closed loop typically takes around 0.1 s from the time the information is received, processed and sent back to the drive. This is far too slow to allow the system to try and respond to a cutting head opening or closing without warning, and the need to know the required flow in order to apply the correct velocity. The closed loop at the computer C runs a real time control algorithm which receives and processes the information in every 0.0025 s which means that it can be completely un-tethered from the machine without any pre-knowledge of the cutting head opening or closing, or what size orifice is in the cutting head (which determines flow at a given pressure).

This feature when combined with the rapid acceleration/deceleration due to the highly compact design means that the pump can be connected to any machine and supply high pressure water that has a constant pressure with minimal pressure variation. Pressure variations are typically due to the plunger reversing time and compression of water within the cylinder (pressure pulse), and lag time in accelerating after the cutting head is opened or decelerating when the cutting head closes (dead head spike). The pump described herein has an extremely high power density which allows for the rapid response required from the mechanics to achieve the constant pressure required for waterjet cutting.

The pressure within the cylinder varies based on the compression and de-compression of the water within the cylinder. Water is approximately 15% compressible at 60,000 psi at 20 deg C., and cylinders expand and seals compress at these extreme pressures. This means the plunger must travel approx. 20% of its stroke to build up 60,000 psi pressure in order to open the high pressure check valves 73. In a position and velocity controlled system, this compression stage would take longer than with a pressure feedback system described above. This is because with the pressure feedback system, as the plunger slows down and begins to reverse the system sees the pressure begin to fall (because there is no additional water going into the system while water is continuing to escape through the orifice in the cutting head) and starts to accelerate faster and faster as the pressure drops. This acceleration continues throughout the compression stage until the check valves open and the additional water has re-pressurised the system to the target pressure where it then decelerates to the velocity required to maintain the desired pressure. The result is a significant reduction in the dip in pressure experienced during the reversing of the plungers (known as "pressure pulse"). A reduced pressure pulse (or constant pressure) is highly desirable in waterjet cutting applications as it allows for faster cutting speeds with higher quality edge finish due to reduced striations. Reduced pressure pulse also results in higher life of the high pressure components such as hoses, fittings, and attenuators.

The servo drive pump described above is far more efficient than an intensifier pump while still offering the desired ability to be able to store and hold pressure while not cutting, thus using only minimal power. The rotor shaft is designed to run at about 1500 rpm and the piston is about 180 mm in length running in a bore with a head diameter of between 14 mm and 22 mm. This makes the whole assembly small, light and considerably quieter than an intensifier pump. The servo drive system is also very responsive and pressures can be adjusted within milliseconds with infinite control.

The pressure feedback loop also enables ready diagnostics of leaks within the system. Through combination of current, position/velocity and pressure, a leak from the low pressure check valve 75 also known as an inlet check valve can be determined. These are regular maintenance items on ultra high pressure pumps, and regularly get small fragments of the wearing components between the sealing surfaces allowing the water to go back down the inlet water supply instead of building up pressure. This would mean that a system without the pressure transducer between the high pressure check valve 73 and the cutting head couldn't determine whether there was a leaking low pressure check valve or a blown high pressure hose or leaking high pressure fitting, because in both cases the current controller feedback (or any other measurement prior to the high pressure check valve) would read the same, whereas the reality is that a completely different response is required for each scenario. A leaking low pressure check valve would need increased velocity to compensate for the leak, whereas a blown high pressure hose or leaking high pressure fitting requires an emergency stop to avoid possible injury. There are numerous scenarios where using the current feedback (or any other measurement prior to the high pressure check valve) to determine pressure, would not be able to correctly diagnose a problem, these include: collapsing guide bush, collapsing seal backing ring, cracked or failed cylinder, seizing bearings or screw, and failed check valves.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The invention claimed is:

1. A waterjet cutting apparatus, comprising:

a cutting head configured to open and close, with pressurized fluid being able to be dispersed from the cutting head when the cutting head is open and the pressurized fluid being prevented from being dispersed from the cutting head when the cutting head is closed;

a pump arranged to pressurize and supply the pressurized fluid to the cutting head, the pump comprising two pistons and two cylinders cooperatively defining two pumping chambers;

a servo motor comprising a hollow rotor and a stator; and a drive mechanism comprising a screw arranged coaxial with the hollow rotor, with opposite ends of the screw being coupled to respective ones of the pistons, the drive mechanism being configured to convert alternating rotation of the hollow rotor to reciprocal linear displacement of the screw to pressurize fluid in the pumping chambers;

a computer-based control system that is operationally connected to the pump, with the control system being configured to control the servo motor, and hence a rate of linear displacement of the screw, such that given geometries of the pumping chambers, pressurized fluid being output by the pump has a fluid pressure greater than 50,000 psi; and a pressure sensor arranged to measure a fluid pressure that is indicative of a pump output pressure of the pressurized fluid being output by the pump, with a signal from the pressure sensor that indicates the measured fluid pressure being provided to the control system as a pressure feedback signal;

wherein the computer-based control system is configured to receive and process the pressure feedback signal to control the pump output pressure, without information pertaining to operation of the cutting head, so as to control pressure pulse and dead head spike and, when the cutting head is closed, to store and hold pressure.

2. The waterjet cutting apparatus of claim 1, further comprising a current monitor arranged to monitor a current flowing through the servo motor.

3. The waterjet cutting apparatus of claim 1, wherein the pumping chambers and the computer-based control system are cooperatively configured such that the pump supplies the pressurized fluid to the cutting head at a rate between 2 L/min (0.53 gpm) and 8 L/min (2.11 gpm), for fluid pressures of at least 50,000 psi.

4. The waterjet cutting apparatus of claim 1, wherein the screw is a ball screw.

5. The waterjet cutting apparatus of claim 1, wherein the pistons each have a stroke length between 100 mm (3.94") and 200 mm (7.87").

6. The waterjet cutting apparatus of claim 1, wherein the computer-based control system is configured to cause the pistons to reciprocate at approximately 60 to 120 strokes per minute.

7. The waterjet cutting apparatus of claim 1, wherein the servo motor is a brushless DC motor.

8. The waterjet cutting apparatus of claim 1, wherein the pressure feedback signal is proportional to the pump output pressure.

9. The waterjet cutting apparatus of claim 1, wherein the servo motor includes an encoder, which monitors a rotational position and/or a rotational velocity of the servo motor.

10. The waterjet cutting apparatus of claim 9, further comprising a current monitor arranged to monitor a current flowing through the servo motor.

11. The waterjet cutting apparatus of claim 1 wherein the computer-based control system is configured to receive and process the pressure feedback signal every 0.0025 s.

12. The waterjet cutting apparatus of claim 11, wherein the servo motor includes an encoder, which monitors a rotational position and/or a rotational velocity of the servo motor.

13. The waterjet cutting apparatus of claim 12, further comprising a current monitor arranged to monitor a current flowing through the servo motor.

14. The waterjet cutting apparatus of claim 11, further comprising a current monitor arranged to monitor a current flowing through the servo motor.

15. The waterjet cutting apparatus of claim 11, wherein the pumping chambers and the computer-based control system are cooperatively configured such that the pump supplies the pressurized fluid to the cutting head at a rate between 2 L/min (0.53 gpm) and 8 L/min (2.11 gpm), for fluid pressures of at least 50,000 psi.

16. The waterjet cutting apparatus of claim 11, wherein the screw is a ball screw.

17. The waterjet cutting apparatus of claim 11, wherein the pistons each have a stroke length between 100 mm (3.94") and 200 mm (7.87").

18. The waterjet cutting apparatus of claim 11, wherein the computer-based control system is configured to cause the pistons to reciprocate at approximately 60 to 120 strokes per minute.

19. The waterjet cutting apparatus of claim 11, wherein the servo motor is a brushless DC motor.

20. The waterjet cutting apparatus of claim 11 wherein the pressure feedback signal is proportional to the pump output pressure.

* * * * *